US006868993B2

(12) United States Patent
Dwinell

(10) Patent No.: US 6,868,993 B2
(45) Date of Patent: Mar. 22, 2005

(54) PAIL VENT AND METHOD

(75) Inventor: Davis B. Dwinell, Carol Stream, IL (US)

(73) Assignee: American Flange Mfg. Co., Inc., Carol Stream, IL (US)

( * ) Notice: Subject to any disclaimer, the term of this patent is extended or adjusted under 35 U.S.C. 154(b) by 196 days.

(21) Appl. No.: 10/217,248

(22) Filed: Aug. 13, 2002

(65) Prior Publication Data

US 2004/0031822 A1 Feb. 19, 2004

(51) Int. Cl.[7] ..... B67D 3/00

(52) U.S. Cl. ..... 222/481.5; 222/541.2; 222/541.5; 222/541.9; 222/570

(58) Field of Search ..... 222/541.2, 541.5, 222/541.9, 570, 481.5

(56) References Cited

U.S. PATENT DOCUMENTS 1,296,341 A 3/1919 Towle
2,750,068 A * 6/1956 Platt, Jr. ..... 220/265
3,062,418 A 11/1962 Andersson
4,034,901 A * 7/1977 Kirk ..... 222/481.5
4,413,753 A * 11/1983 Stock ..... 222/149
4,747,501 A * 5/1988 Greaves ..... 215/253
5,893,489 A * 4/1999 Giarrante ..... 222/482
5,906,288 A 5/1999 Dwinell
5,950,876 A * 9/1999 McLelland et al. .... 222/153.06

* cited by examiner

*Primary Examiner*—Joseph A. Kaufman

(57) ABSTRACT

A plastic pail having a dispensing closure and a diametrically opposed puncture zone to enable surge free pouring. The dispensing closure has a flexible pouring spout and threaded overcap. The spout dispensing passage is closed off by a tear out sealing diaphragm in initial shipping condition The puncture zone is surrounded by an upstanding retaining collar dimensioned to receive the separated tear out diaphragm which acts as a protective cover for the punctured anti-glug vent during storage and handling.

13 Claims, 2 Drawing Sheets

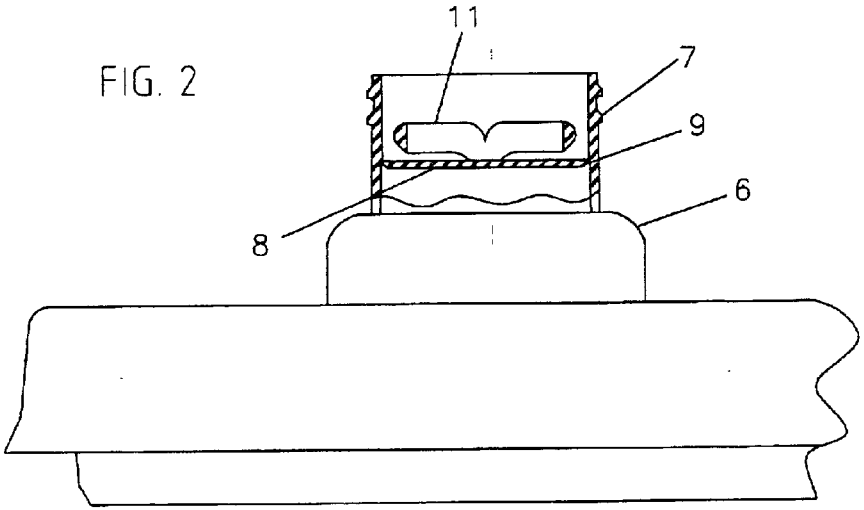
FIG. 2
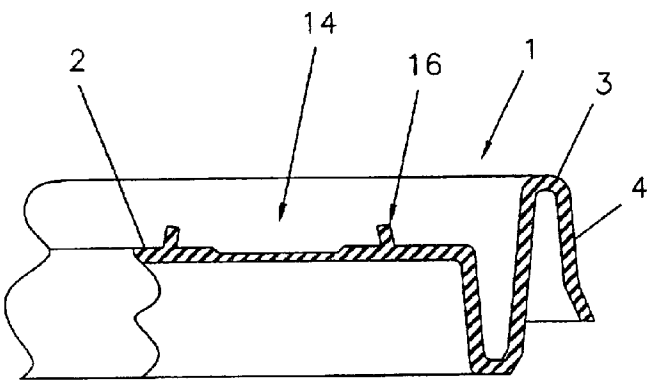
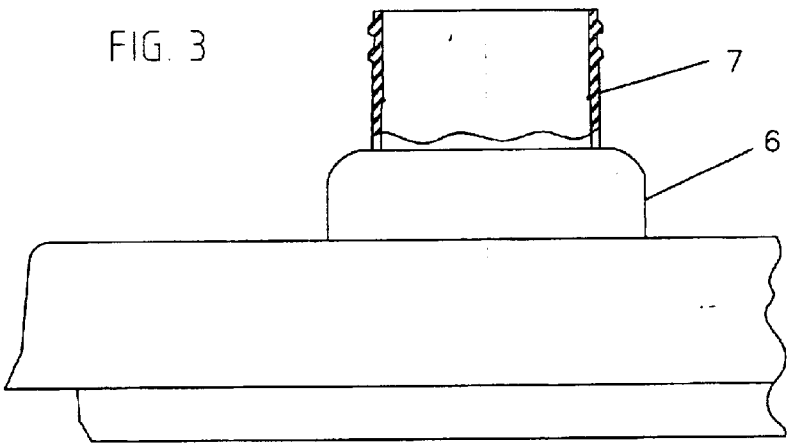
FIG. 3
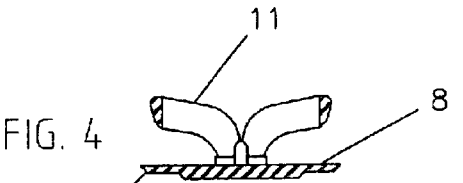
FIG. 4
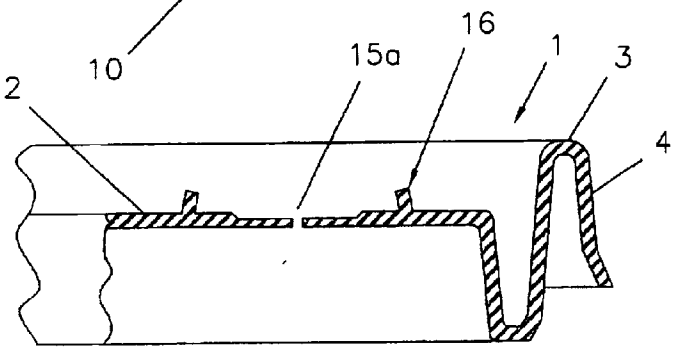

PAIL VENT AND METHOD

BACKGROUND OF THE INVENTION

In the dispensing of fluid from relatively large volume containers such as closed pails or buckets, smooth rapid flow is best achieved by providing an air entry aperture in the pail lid diametrically opposite the dispensing opening. This is, of course, most easily achieved by simply punching a hole in the pail lid with an available implement such as a screwdriver with excellent pouring results. However, an open aperture in the pail top invites the entry of surface contaminants and is generally unacceptable. This can be overcome with the provision of a special opening formed in the pail lid into which a recloseable venting closure is inserted during the pail manufacture. This works very nicely but entails an objectionable added cost factor. Numerous more expensive self venting pouring spouts have entered the market which to a certain degree lessen the additional manufacturing cost by eliminating the added labor component but fall far short in pouring performance from that resulting from the simple remotely positioned puncture vent. Allowing atmospheric air to directly enter the container head space clearly yields a better venting condition than attempting to accomplish both air entry and fluid exit from the dispensing opening which is of necessity positioned farthest from the container bead space. The best of "both worlds"—cost and performance would seem to lie in the remote puncture vent approach but which could be effectively reclosed to prevent the entry of foreign matter and surface liquid as well as preventing spillage and evaporation. To date, however, attempts in this direction have lacked practicality of molding in plastic lids in addition to including an undesirably complex puncturing step. Most importantly the desired effective reclosing of the vent opening has remained elusive.

SUMMARY OF THE INVENTION

This invention offers a practical solution to the above mentioned prior art problem of attaining optimum pouring speed and smoothness of flow without permitting the entry of contaminants into the pail and at the same time without increasing the unit cost of the container. This is accomplished by a very minor modification of an already existing pail lid and dispensing closure construction. Most commonly pails or buckets in the five gallon range and particularly such containers molded of plastic resins are outfitted with a flexible pouring spout affixed to the lid opening and provided with a recloseable screw cap. Underneath the screw cap in the initial unopened state there is an integrally molded frangible sealing diaphragm closing off the spout opening which, prior to pouring, is easily torn out with an integrally connected ring pull member. This torn out closure component is normally just discarded or more likely becomes a piece of litter. In the invention construction and method this litter serves a very useful purpose. A puncture zone is formed in the pail lid diametrically opposite the dispensing closure surrounded by a retaining collar dimensioned to provide a snap fit upon insertion of the torn out sealing diaphragm. Thus it can be seen that in initially readying the pail for pouring, the puncture zone is penetrated with a screw drive or similar implement creating an air entry passage. The screw cap is removed after extending the spout and the spout sealing diaphragm torn out. After dispensing a desired quantity in a smooth surge free fashion, the torn sealing diaphragm is simply snapped into the retaining collar thus closing off the punctured opening and protecting against the unwanted entry of collected water or foreign matter.

It is accordingly a principal object of the invention to provide a new and improved anti-glug pouring vent arrangement and method for industrial size containers.

A further object is to provide a recloseable anti-glug pouring vent integrally molded in the lid of a plastic pail diametrically opposite a full flow dispensing closure.

A more detailed object is to provide a pail lid construction and method to enable surge free pouring and reclosing utilizing existing closure components.

Further and more detailed objects will in part be apparent and in part pointed out as the description of the invention taken in conjunction with the accompanying drawing proceeds.

In that Drawing:

FIG. 2 is a part elevational, part sectional view of the pail lid partially readied for pouring;

FIG. 3 is a view similar to FIG. 2 with the pail lid readied for pouring;

FIG. 4 is a sectional view of the sealing diaphragm;

DETAILED DESCRIPTION OF THE INVENTION

Figure 1:
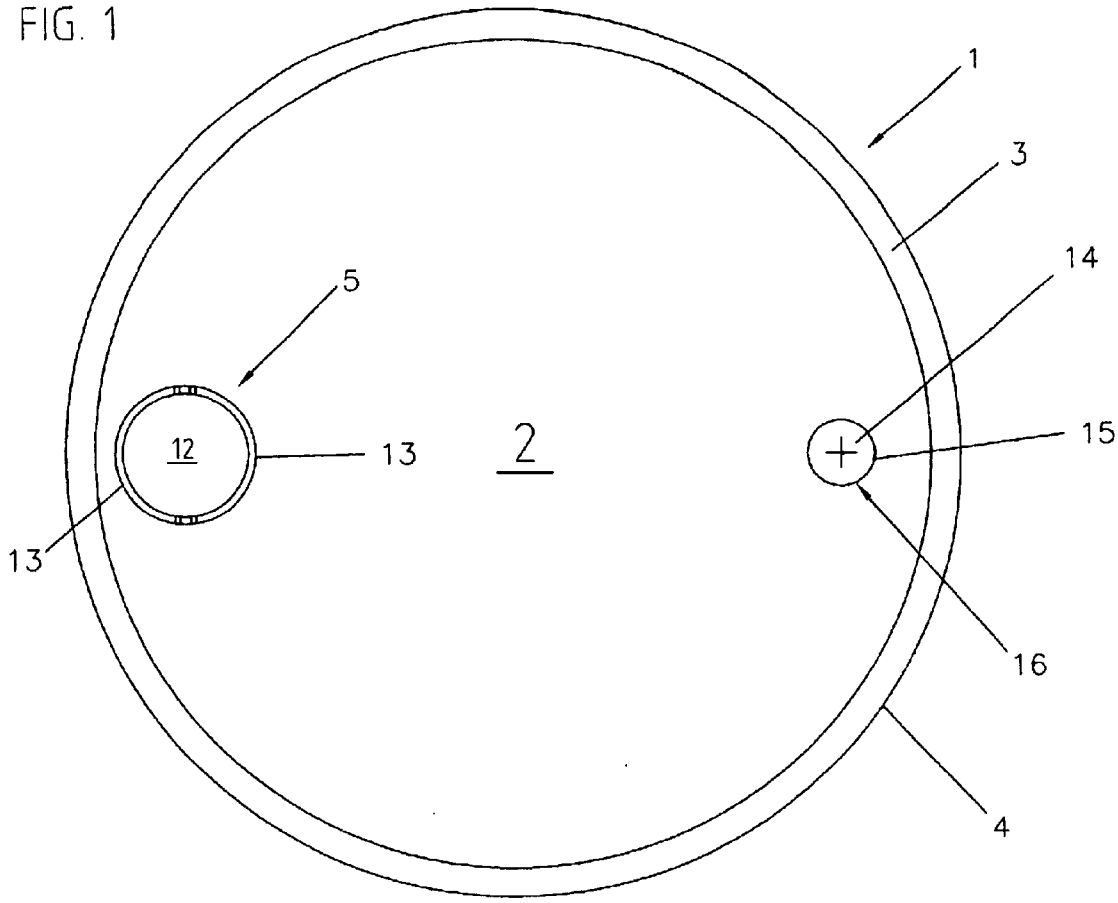
FIG. 1 is a part elevational, part sectional view of the pail lid partially readied for pouring'

The pail lid of the invention generally indicated by numeral 1 has a disc like center panel 2 surrounded by a raised chime 3 which extends into an outer peripheral sidewall 4. A known flexible spout closure 5 such as the type disclosed in U.S. Pat. No. 6,386,405 is affixed to the pail lid center panel 2 at a position adjacent the chime 3 for convenient fluid dispensing. The closure 5 has a lower flexible wall 6 and an upper externally threaded neck 7. A disc like sealing diaphragm 8 is integrally molded within the neck 7 so as to close off the interior passage therethrough. The sealing diaphragm is integrally connected to the cylindrical interior surface of the neck 7 by an annular score line 9 to facilitate tearing. Immediately below the score line the sealing diaphragm is formed at its periphery with an inwardly and downwardly extending conical edge surface 10. A ring pull 11 suitable for reception of a persons finger is also integrally molded as part of the sealing diaphragm. A closure cap 12 is threadedly engaged on the spout neck 7 and provided with a pair of semi circular lifting bails 13 which enable extension of the spout lower wall 6 in preparation for pouring.

Diametrically opposite the dispensing closure 5 on the pail lid center panel 2 is a puncture zone 14 provided with a pair of crossed score lines 15 creating an area of relative weakness. An upstanding collar 16 surrounds the puncture zone 14 making it readily discernible having an outer conical surface 17 and an inner conical surface 18. The top annular surface 19 of the collar is also inclined upwardly and outwardly.

In practice a sealed, unopened pail is readied for pouring by folding up the lifting bails 13 on cap 12 and using the cap to raise the lower spout wall 6 to extended pouring position as seen in FIG. 2. The cap 12 is then unscrewed from the spout neck thread 7 exposing the sealing diaphragm 8 and ring pull 11. Once the diaphragm is torn out, liquid lading can be dispensed from the pail. However, if it is desired to have either a very rapid emptying of the pail or a controlled, surge free dispensing of a portion of the pail contents, then it is imperative outside air somehow enter the pail interior as fluid exits. This is most simply and most cost effectively accomplished by simply puncturing the weakened score line 15 in the puncture zone with any rigid implement such as a screwdriver, creating an air entry passage 15*a*.

Figure 6:
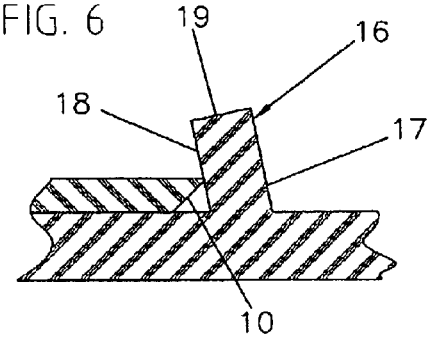
FIG. 6 is a fragmentary sectional view of the vent in reclosed condition.
Figure 5:
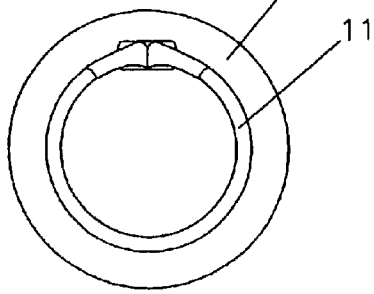
FIG. 5 is a top plan view of the sealing diaphragm.

Upon completion of the desired dispensing in a rapid, controlled manner the punctured anti-glug vent opening is effectively closed off by taking the torn out ring pull diaphragm 8 which would otherwise be a piece of litter and snapping it into the upstanding collar 16. As clearly seen in FIG. 6 the diaphragm 8 readily locates on the inclined top surface 19 of the collar and then is pressed against the lid surface with the diaphragm outer edge surface 10 snapping past the collar top surface 19 to become tightly captured by the collar inner conical surface 18. In this position the ring pull diaphragm 8 effectively covers the puncture opening 15*a* so as to prevent the entry of dirt and foreign matter from entering the pail. In addition the ring pull diaphragm acts as a splash guard preventing the exit of liquid during handling and jostling of the pail. Moreover, any collection of contaminated spillage or rainwater is kept away from the puncture opening 15*a* by the upstanding collar 16. From another perspective when pails are stacked one on top of another either in storage or in palletization on the filling line, the conical exterior collar surface 17 allows the bottom of one pail to slide over the top surface of the pail below it without damage.

When it comes time to pour from the pail, whether a small controlled surge free dispensing is desired or a fast anti-glug emptying of the entire contents, one can simply grasp the ring pull 11 and lift upwardly causing a deflection of the diaphragm 8 releasing the edge 10 thereof from the collar inner diameter conical surface 18. This then allows air to freely enter the puncture air passage 15*a* during pouring. Of course the ring pull diaphragm acting as a closure member can be snapped in and out of the collar 16 repeatedly. Thus it can be seen that an essential closure component that would otherwise be simply discarded as a piece of trash or litter is employed in a very useful and productive manner to significantly enhance the value and functionality of the pail.

Various other changes in or modification of the anti-glug pouring vent and method of the invention would suggest themselves to those skilled in the art and could be made without departing from the spirit or scope of this invention. It is accordingly intended that all matter contained in the above description or shown in the accompanying drawing shall be interpreted as being illustrative and not in a limiting sense.

I claim:

1. An anti-glug vent for containers comprising a plastic dispensing closure having a fluid exit passage, a frangible sealing diaphragm closing off said exit passage, a puncture zone in said container remote from said closure, retaining means surrounding said puncture zone and said retaining means dimensioned to receive said sealing diaphragm after separation from said exit passage so as to prevent both spillage out of and foreign matter entry into said puncture zone.

2. An anti-glug vent as in claim 1 and said retaining means comprising an upstanding collar.

3. An anti-glug vent as in claim 2 and diaphragm engaging means on the inside of said collar.

4. An anti-glug vent as in claim 3 and said engaging means consists of a collar diameter smaller than said diaphragm and a collar diameter larger than said diaphragm.

5. A pail lid comprising a disc like center panel surrounded by a peripheral sidewall, a relatively large closure receiving opening formed in said center panel adjacent said side wall, a relatively small imperforate puncture zone formed in said center panel adjacent said sidewall remote from said closure receiving opening and intergrally formed means closely surrounding said puncture zone extending axially of said center panel making said puncture zone readily discernible for puncturing with a sharp implement.

6. A pail lid as in claim 5 and said puncture zone surrounding means providing a barrier against surface contamination entering said puncture zone.

7. A pail lid as in claim 6 and said puncture zone surrounding means comprising an upstanding annular collar.

8. A pail lid as in claim 7 and said collar having a radial undercut thereon.

9. A pail lid as in claim 8 wherein said radial undercut is disposed on the interior of said collar.

10. A pail lid as in claim 7 and said collar having a conical exterior surface.

11. A method of venting head space in a container to atmosphere during pouring wherein the container is equipped with dispensing closure and a puncture zone remote from the dispensing closure, comprising puncturing a hole in the puncture zone to equalize internal pressure in the container to enable smooth surge free pouring and utilizing a discardable portion of said dispensing closure to cover the hole in said puncture zone so that entry of foreign matter is prevented.

12. A method as in claim 11 and utilizing a frangible portion of said dispensing closure to cover the hole in said puncture zone.

13. A method as in claim 12 and utilizing a tear out sealing diaphragm from pail dispensing closure to cover the hole in said puncture zone.

* * * * *